US007233283B2

(12) United States Patent
Kikuchi

(10) Patent No.: US 7,233,283 B2
(45) Date of Patent: Jun. 19, 2007

(54) DIRECTIONAL ANTENNA CONTROL DEVICE, BEAM SELECTING METHOD THEREFOR, AND PROGRAM

(75) Inventor: Tohru Kikuchi, Tokyo (JP)

(73) Assignee: NEC Corporation, Tokyo (JP)

( * ) Notice: Subject to any disclaimer, the term of this patent is extended or adjusted under 35 U.S.C. 154(b) by 557 days.

(21) Appl. No.: 10/759,487

(22) Filed: Jan. 20, 2004

(65) Prior Publication Data

US 2004/0147290 A1 Jul. 29, 2004

(30) Foreign Application Priority Data

Jan. 22, 2003 (JP) ..... 2003/012936

(51) Int. Cl.
*H01Q 3/12* (2006.01)

(52) U.S. Cl. ..... 342/374; 342/372

(58) Field of Classification Search ..... 342/368, 342/372, 374; 455/63.4, 550.1, 562.1
See application file for complete search history.

(56) References Cited

U.S. PATENT DOCUMENTS 6,049,307 A * 4/2000 Lim ..... 342/383
6,347,220 B1 * 2/2002 Tanaka et al. ..... 455/277.2
6,438,389 B1 * 8/2002 Sandhu et al. ..... 455/562.1
2004/0131134 A1 * 7/2004 Hiroyasu ..... 375/347

FOREIGN PATENT DOCUMENTS

| | | |
|---|---|---|
| EP | 0 595 247 A1 | 5/1994 |
| EP | 1 026 835 A2 | 8/2000 |
| EP | 1 202 389 A1 | 5/2002 |
| JP | 2002-135032 | 5/2002 |

OTHER PUBLICATIONS

W-CDMA Mobile Communication System; Maruzen Co., LTD.; Jun. 25, 2001 pp. 79-86.
Korean Office Action dated Jan. 17, 2006 (and English translation of same).

* cited by examiner

*Primary Examiner*—Dao L. Phan
(74) *Attorney, Agent, or Firm*—Dickstein, Shapiro, LLP.

(57) ABSTRACT

A directional antenna control device is provided which is capable of reducing processing amount and time necessary for power detection and selection of multibeam. A beam power detecting part detects power levels of all M beams in unit time period for initial beam switching. A beam output selection combining part selects a beam having the largest power in accordance with the detected power levels, and outputs received data based on the selected beam. A detection beam selecting part notifies the beam power detecting part in unit time period for second beam switching, of beam numbers of the selected beam, m beams adjacent thereto and n beams out of all beams except for the selected beam and m beams. The beam power detecting part detects power levels of only the beams having the notified beam numbers.

10 Claims, 4 Drawing Sheets

DIRECTIONAL ANTENNA CONTROL DEVICE, BEAM SELECTING METHOD THEREFOR, AND PROGRAM

BACKGROUND OF THE INVENTION

1. Field of the Invention

The present invention relates to a directional antenna control device, a beam selecting method therefor, and a program, and more particularly, to a method for controlling directivities of a plurality of array antenna elements provided at a base station that receive incoming radio waves.

2. Description of the Related Art

Great expectations have been focused on a CDMA (Code Division Multiple Access) system that will be a radio access system for next-generation mobile communication cellular system because it may significantly increase a subscriber capacity.

Such a CDMA system is, however, prone to interference that is produced on a base station receiving side due to signals from other users making an access on the same carrier at the same time and also produced on a mobile station receiving side due to signals transmitted from the base station to other users. To eliminate this interference, there has been provided array antenna-based technology (e.g., see "W-CDMA Mobile Communication System" (published by MARUZEN CO., LTD. on 25 Jun. 2001, edited by Keiji Tachikawa, Pages 79 to 86)).

The array antenna receiving signals by a plurality of antenna elements contributes to suppression of interference with signals of other users by applying complex weights to the received signals and combining the resulting signals to control amplitudes and phases of the received signals from each antenna so as thereby to form a directional beam. A multibeam system is one example of control methods for such an array antenna. FIG. 4 shows a block diagram showing a conventional directivity control device employing the multibeam system.

According to the multibeam system in FIG. 4, a receiving array antenna unit 1 receives signals by N antenna elements 11 to 1N (N is an integer grater than one) arranged close to each other, and then an A/D (Analog/Digital) conversion unit 2 converts the received signals from analog to digital at A/D converters 21 to 2N provided for the antenna elements 11 to 1N, respectively.

The received signals are multiplied by weighting factors calculated in advance, in a reception beam forming unit 3 at multipliers (not shown) of each provided in beam formers 31 to 3M (M is an integer greater than one) for forming M fixed beams. The products are combined and then multiplied by weighting factors calculated in advance, and further combined, so that the phase and amplitude of the received signals are controlled, thereby forming a beam formed in a specific direction.

The M fixed beams are provided so as to cover, as uniformly as possible, a predetermined space region such as a sector. A beam power detection unit 5 measures power levels of the beams from the beam formers 31 to 3M at beam power detecting parts 51 to 5M, and notifies a beam output selection combining unit 6 of both the measured power levels and beam numbers thereof. The beam output selection combining unit 6 selects and combines one or more beams having large power levels by referring to the measured power levels, and then outputs the combined beam as received data.

With the above-described conventional multibeam system, the beam power detection unit 5 measures the power levels of all the fixed beams, and then a beam to be received is determined on the basis of the power levels. At this time, the resolution to an incoming direction of the received signal depends on the number of fixed beams.

Therefore, the resolution may be enhanced by increasing the number of fixed beams. This, however, leads to an inevitable increase in operation amount both of the beam formers 31 to 3M and of the beam power detection unit 5.

SUMMARY OF THE INVENTION

An object of the present invention is to provide a directional antenna control device that is capable of reducing processing amount and time necessary for power detection and selection of multiple beams in a simple way, and also a beam selecting method employed for the device and its program.

A directional antenna control device according to the present invention is a directional antenna control device which forms a plurality of fixed beams based on signals received by a plurality of array antenna elements, detects power levels of the fixed beams, and selects a fixed beam in accordance with the detected power levels to generate a received signal based on the selected beam, the device comprising detecting means for detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams, and selecting means for selecting a fixed beam having the largest power in accordance with the power levels detected by the detecting means.

Another directional antenna control device according to the present invention is a directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the device comprising detecting means for detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams, and selecting means for selecting a fixed beam having the largest SIR value in accordance with the SIRs detected by the detecting means.

A beam selecting method according to the present invention is a beam selecting method for a directional antenna control device which forms a plurality of fixed beams based on signals received by a plurality of array antenna elements, detects power levels of the fixed beams, and selects a fixed beam in accordance with the detected power levels to generate a received signal based on the selected beam, the method comprising a detecting step of detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams, and a selecting step of selecting a fixed beam having the largest power in accordance with the power levels detected in the detecting step.

Another beam selecting method according to the present invention is a beam selecting method for a directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the method comprising, a detecting step of detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams, and a selecting step of selecting a fixed beam having the largest SIR value in accordance with the SIRs detected in the detecting step.

A program according to the present invention is a program for causing a computer to execute a beam selecting method for a directional antenna control device which forms a plurality of fixed beams based on signals received by a plurality of array antenna elements, detects power levels of the fixed beams, and selects a fixed beam in accordance with the detected power levels to generate a received signal based on the selected beam, the program comprising, a detecting step of detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams, and a selecting step of selecting a fixed beam having the largest power in accordance with the power levels detected in the detecting step.

Another program according to the present invention is a program for causing a computer to execute a beam selecting method for a directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the program comprising, a detecting step of detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams, and a selecting step of selecting a fixed beam having the largest SIR value in accordance with the SIRs detected in the detecting step.

One aspect of the present invention is a directional antenna control device having a plurality of array antenna elements, means for forming a plurality of fixed beams based on signals received by the plurality of array antenna elements, and means for detecting power levels of the fixed beams and selecting a fixed beam in accordance with the detected power levels, and this control device generates a received signal based on the selected beam.

The means for selecting a fixed beam comprises detecting means for detecting, per unit time period for beam switching, a power level of a fixed beam selected in the previous unit time period, power levels of m fixed beams (where m is a positive integer) adjacent to the fixed beam selected in the previous unit time period and power levels of n fixed beams (where n is a positive integer) of the plurality of fixed beams except for the fixed beam selected in the previous unit time period and the m fixed beams, and selecting means for selecting a fixed beam having the largest power in accordance with the power levels detected by the detecting means.

Another aspect of the present invention is a directional antenna control device having a plurality of array antenna elements, means for forming a plurality of fixed beams based on signals received by the plurality of array antenna elements, and means for detecting SIRs (Signal-to-Interference power Ratios) of the fixed beams and selecting a fixed beam in accordance with the detected SIRs, and this control device generates a received signal based on the selected beam.

The means for selecting a fixed beam comprises detecting means for detecting, per unit time period for beam switching, an SIR of a fixed beam selected in the previous unit time period, SIRs of m fixed beams (where m is a positive integer) adjacent to the fixed beam selected in the previous unit time period and SIRs of n fixed beams (where n is a positive integer) of the plurality of fixed beams except for the fixed beam selected in the previous unit time period and the m fixed beams, and selecting means for selecting a fixed beam having the largest SIR value in accordance with the SIRs detected by the detecting means.

The directional antenna control device of the present invention which is thus configured is capable of reducing processing amount and time necessary for power detection and selection of multiple beams in a simple way.

DETAILED DESCRIPTION OF THE PREFERRED EMBODIMENTS

Figure 1:
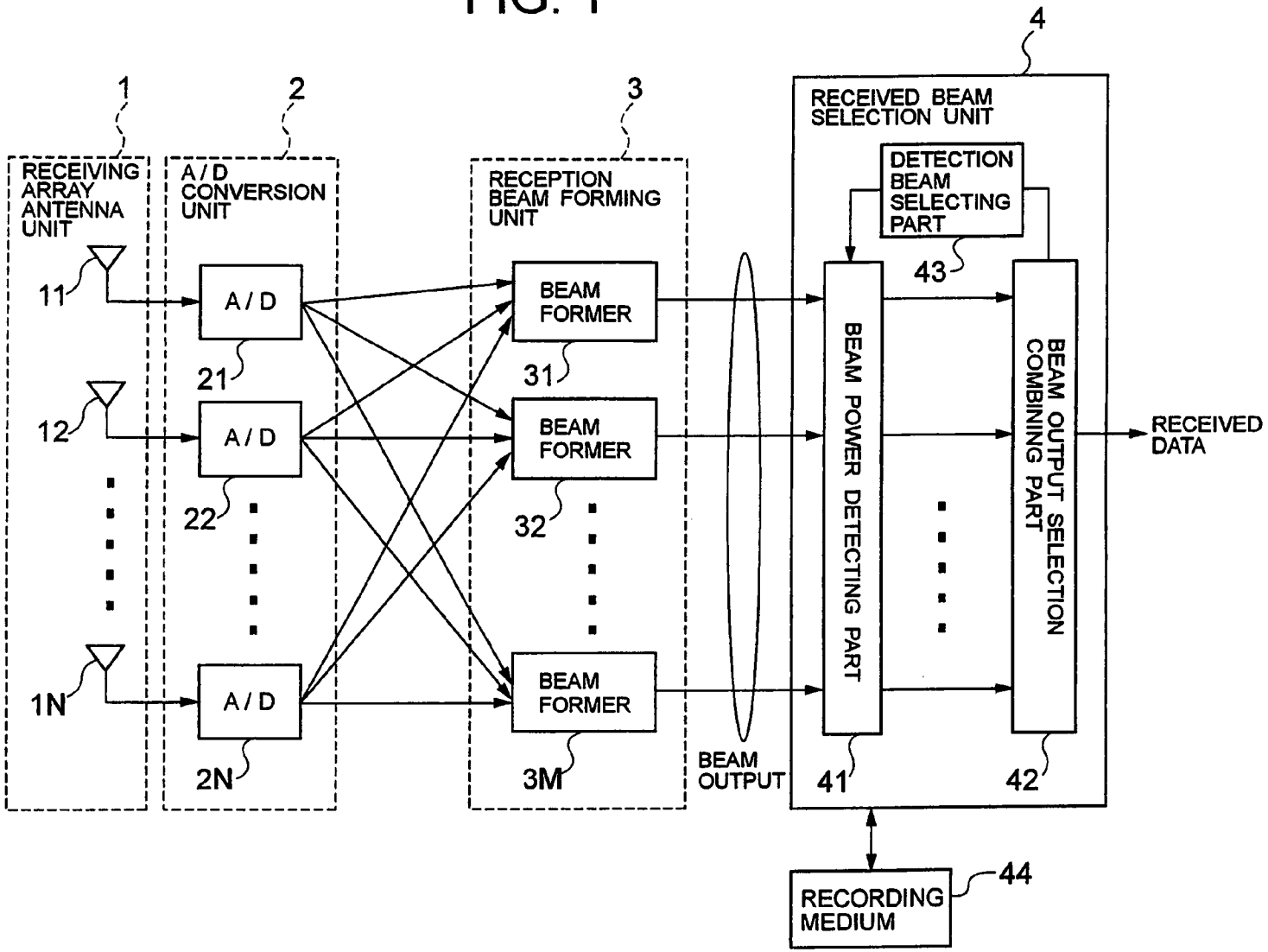
FIG. 1 is a block diagram showing a configuration of a directional antenna control device according to an embodiment of the present invention.
Figure 4:
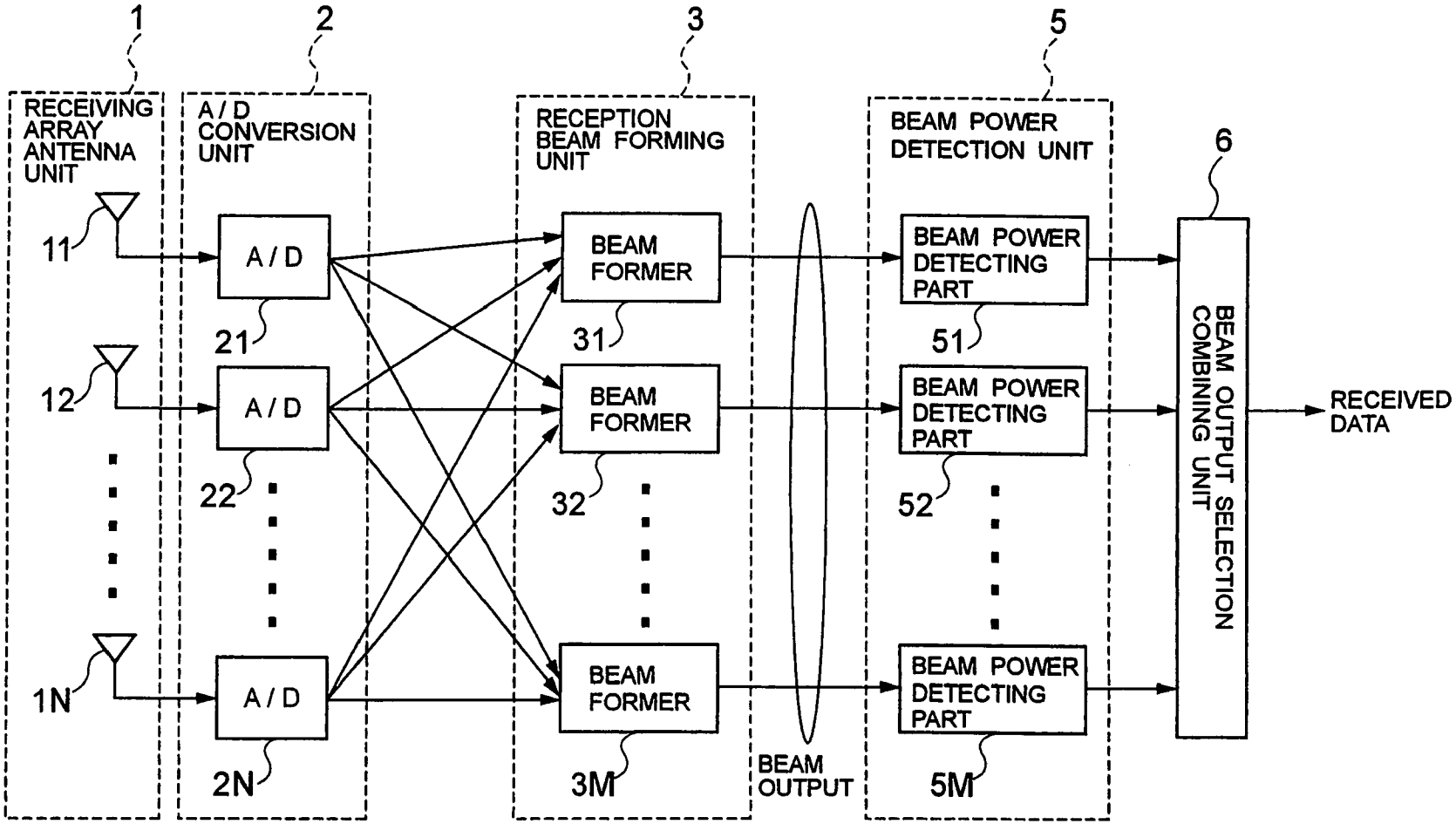
FIG. 4 PRIOR ART
FIG. 4 is a block diagram showing one example of a configuration of a conventional directional antenna control device.

A preferred embodiment of the present invention will be described by referring to the accompanying drawings. FIG. 1 is a block diagram showing a configuration of a directional antenna control device according to an embodiment of the present invention. As observed from FIG. 1, the directional antenna control device comprises a receiving array antenna unit 1 having N antenna elements 11 to 1N (N is an integer greater than one) arranged close to each other, an A/D (Analog/Digital) conversion unit 2 having A/D converters 21 to 2N provided for the antenna elements 11 to 1N, respectively, a reception beam forming unit 3 having beam formers 31 to 3M (M is an integer greater than one) for forming M fixed beams, and a received beam selection unit 4. In this embodiment, the components except for the received beam selection unit 4 are the same as those of the conventional directional antenna control device shown in FIG. 4, so the same reference numerals are allocated thereto.

The received beam selection unit 4 comprises a beam power detecting part 41, a beam output selection combining part 42, a detection beam selecting part 43, and a recording medium 44. The beam power detecting part 41 detects power levels of beams, and the beam output selection combining part 42 selects a beam having the maximum power in accordance with the detected beam power levels. The detection beam selecting part 43 notifies the beam power detecting part 41 per unit time for the second and subsequent beam switching, of beam numbers of both the beam selected by the beam output selection combining part 42 and m beams (m is a positive integer) adjacent thereto, as well as beam numbers of n beams (n is a positive integer) out of all beams except for the above m+1 beams. The recording medium 44 stores therein a program (operable in a computer) for implementing operations of each part.

Figure 2:
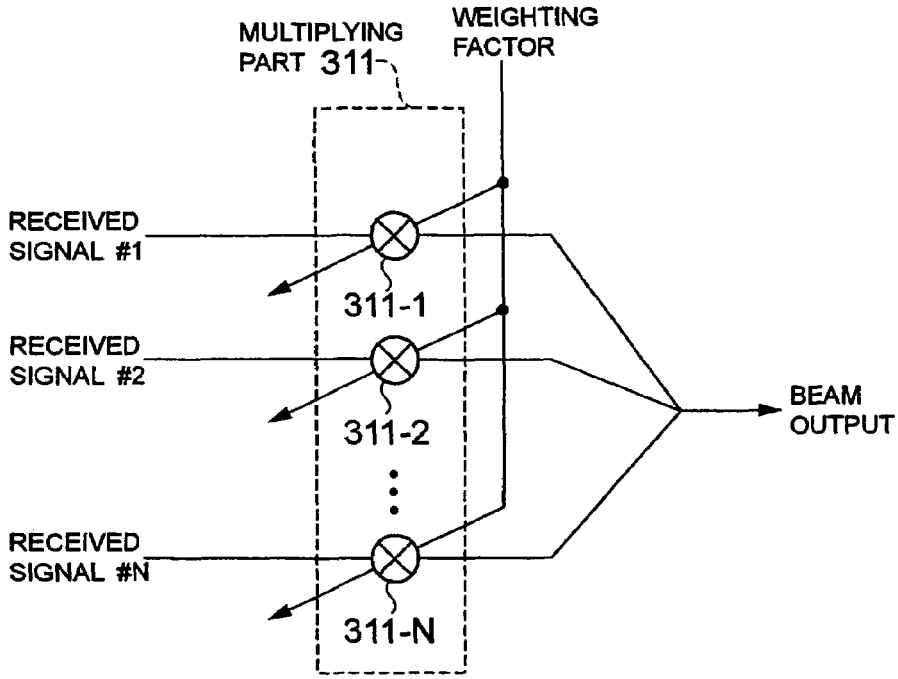
FIG. 2 is a block diagram showing a configuration of a beam former in FIG. 1.

FIG. 2 is a block diagram showing a configuration of the beam former 31 in FIG. 1. The beam former 31 has a multiplying part 311 comprising multipliers 311-1 to 311-N that are provided for the A/D converters 21 to 2N, respectively, where signal weighting and combining are performed based on weighting factors calculated ahead so as to provide M multibeam outputs. Although not shown, other beam formers 32 to 3M have the same configuration as the beam former 31.

Referring now to FIGS. 1 and 2, description will be made for operations of the directional antenna control device according to the embodiment of the present invention.

Signals received at the N array antenna elements 11 to 1N are A/D converted at the A/D converters 21 to 2N. The received signals are input from the A/D converters 21 to 2N to each of the M beam formers 31 to 3M.

The beam formers 31 to 3M each perform weighting and combining of the received signals with the weighting factors calculated ahead at the multipliers 311-1 to 311-N, as illustrated in FIG. 2, so as thereby to provide M multibeam outputs. The M beam outputs from the beam formers 31 to 3M are input into the received beam selection unit 4.

Upon receipt of the beam outputs, the beam power detecting part 41 detects beam power levels of all the M beam outputs in unit time period for initial beam switching, and inputs the results and the beam outputs to the beam output selection combining part 42. The beam output selection combining part 42 selects a beam output having the greatest beam power in accordance with the detected beam power levels to output the selected beam as received data, and also inputs the beam number of the selected beam to the detection beam selecting part 43.

The detection beam selecting part 43 notifies the beam power detecting part 41 per unit time for second and subsequent beam switching, of beam numbers of both the beam selected by the beam output selection combining part 42 and m beams adjacent thereto, and beam numbers of n beams out of all beams except for the above m+1 beams. In order to measure power levels of all beams within a predetermined time period, a combination of the n beams is changed to another combination of the n beams per unit time for beam switching.

The beam power detecting part 41 detects power levels of only the beams having the beam numbers notified by the detection beam selecting part 43. Therefore, the processing amount involved in power calculation can be reduced.

The next paragraphs will explain the operations of the directional antenna control device according to the embodiment of the present invention in further detail. The receiving array antenna unit 1 has the array antenna elements 11 to 1N that receive CDMA (Code Division Multiple Access) signals.

The A/D conversion unit 2 has the N A/D converters 21 to 2N that perform A/D conversion of the outputs from the array antenna elements 11 to 1N. The reception beam forming unit 3 has the M beam formers 31 to 3M that perform beam-forming of multibeam in response to output of the A/D conversion unit 2 and provides M beam outputs. Upon receipt of outputs from the beam formers 31 to 3M, the received beam selection unit 4 detects power levels of each beam to generate received data based on a beam output having the largest beam power.

Figure 3:
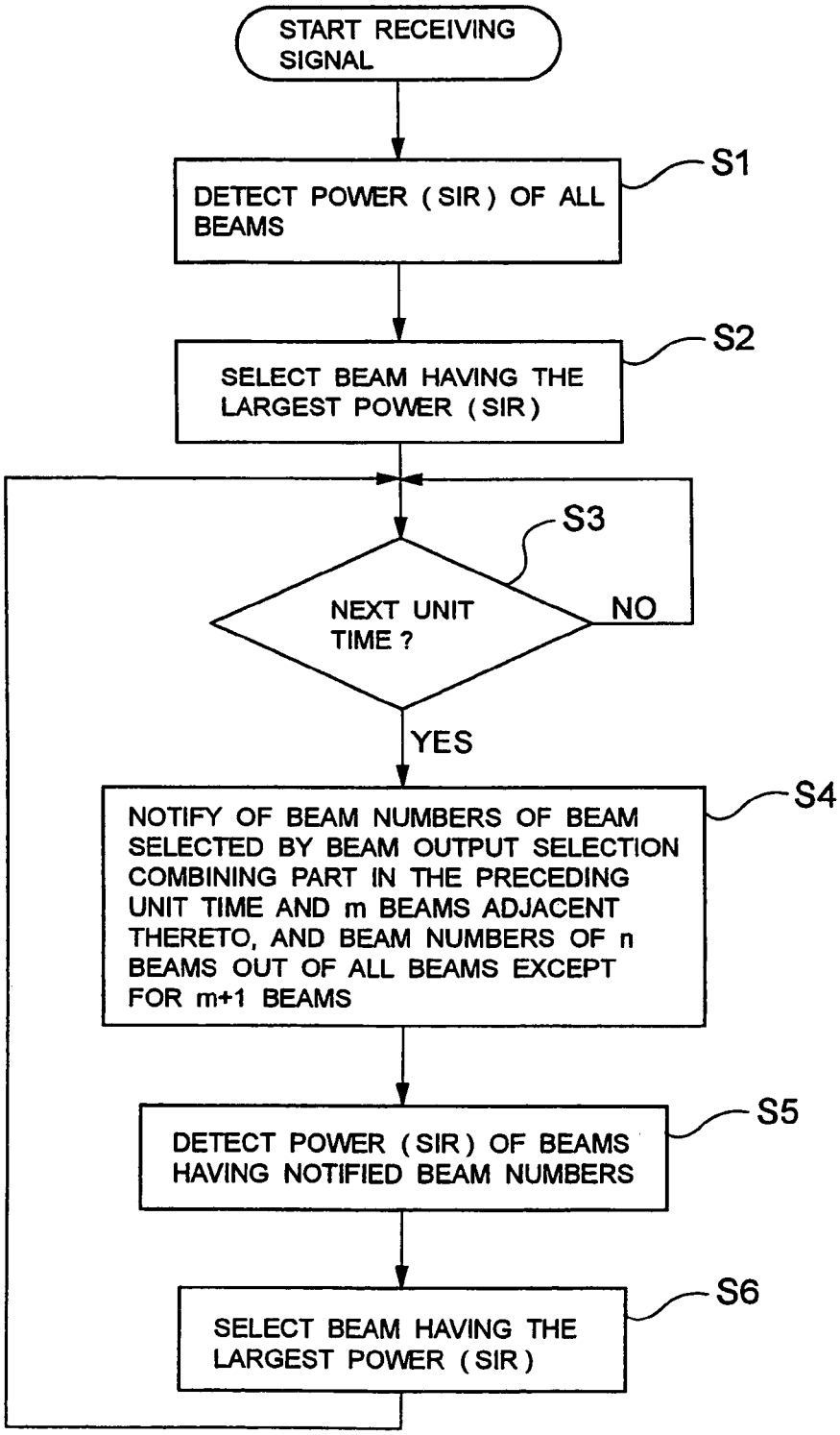
FIG. 3 is a flowchart for operations of a received beam selection unit in FIG. 1.

FIG. 3 is a flowchart of operations in the received beam selection unit 4. Referring to FIGS. 1 to 3, the operations of the received beam selection unit 4 will be described in further detail. The operations shown in FIG. 3 are realized when a computer (not shown) executes a program stored in the recording medium 44.

When the received beam selection unit 4 receives beam outputs from the beam formers 31 to 3M, the beam power detecting part 41 detects power levels of all beams output from the beam formers 31 to 3M in unit time period for initial beam switching (step S1).

The beam output selection combining part 42 selects a beam having the greatest beam power in accordance with the detected power levels to generate received data based on the selected beam (step S2). The beam number of the selected beam is input to the detection beam selecting part 43.

In unit time period for the second time of beam switching (step S3), the detection beam selecting part 43 selects the beam selected in step S2, m beams adjacent thereto, and n beams out of all beams except for those m+1 beams, and notifies the beam power detecting part 41 of beam numbers for these m+n+1 beams (step S4). The beam power detecting part 41 detects power levels of both the m+1 beams and the n beams (step S5). The beam output selection combining part 42 selects a beam having the greatest beam power on the basis of the detected power levels, and generates received data based on the selected beam (step S6). The beam number of the selected beam is input to the detection beam selecting part 43.

In unit time period for the third time of beam switching (step S3), the detection beam selecting part 43 notifies the beam power detecting part 41, of beam numbers of the beam selected in step S6 and m beams adjacent thereto, and beam numbers of n beams out of all beams except for these m+1 beams (step S4). The beam power detecting part 41 detects power levels of those m+n+1 beams (step S5), and the beam output selection combining part 42 selects a beam having the largest power on the basis of the detected power levels (step S6). Also in every unit time period for fourth and subsequent beam switching, the processing operations in steps S3 and S4 as described above are performed.

A combination of the n beams is changed to another combination of the n beams per unit time for beam switching so that the power levels of all beams are measured within the predetermined time period.

As described above, the beam power detecting part 41 detects, from all M fixed beams, power levels of a fixed beam having the largest beam power and m fixed beams adjacent to the fixed beam having the largest beam power. In addition, the beam power detecting part 41 detects power levels of n fixed beams out of all M fixed beams except for these m+1 beams. Then, the beam output selection combining part 42 selects a beam having the largest beam power in accordance with the detected power levels of those m+n+1 beams. This allows a reduction in processing amount and time necessary for the power detection and selection of multibeam.

While the above description of this embodiment dealt with the case where a beam is selected with reference to beam power, an SIR (Signal-to-Interference power Ratio) of each beam is also applicable as a selection criterion, where operations are the same as those illustrated in FIG. 3.

Also, the present invention is applicable to general multi-beam devices, including those employing not only a CDMA system but also a TDMA (Time Division Multiple Access) system and an FDMA (Frequency Division Multiple Access) system.

Furthermore, the present invention is by no means limited to the technology in the foregoing description, and various changes and modifications may be appropriately made in the present invention without departing from the sprit and scope thereof.

What is claimed is:

1. A directional antenna control device which forms a plurality of fixed beams based on signals received by a plurality of array antenna elements, detects power levels of the fixed beams, and selects a fixed beam in accordance with the detected power levels to generate a received signal based on the selected beam, the device comprising:

detecting means for detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams; and selecting means for selecting a fixed beam having the largest power in accordance with the power levels detected by said detecting means.

2. The directional antenna control device according to claim 1, wherein a combination of the n fixed beams is changed to another combination of the n fixed beams per unit time period for beam switching so that the power levels of all the plurality of fixed beams are measured within a predetermined time period.

3. A directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the device comprising:

detecting means for detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams; and selecting means for selecting a fixed beam having the largest SIR value in accordance with the SIRs detected by said detecting means.

4. The directional antenna control device according to claim 3, wherein a combination of the n fixed beams is changed to another combination of the n fixed beams per unit time period for beam switching so that the SIRs of all the plurality of fixed beams are measured within a predetermined time period.

5. A beam selecting method for a directional antenna control device which forms a plurality of fixed beams based on signals received by a plurality of array antenna elements, detects power levels of the fixed beams, and selects a fixed beam in accordance with the detected power levels to generate a received signal based on the selected beam, the method comprising:

a detecting step of detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams; and a selecting step of selecting a fixed beam having the largest power in accordance with the power levels detected in said detecting step.

6. The beam selecting method according to claim 5, wherein a combination of the n fixed beams is changed to another combination of the n fixed beams per unit time period for beam switching so that the power levels of all the plurality of fixed beams are measured within a predetermined time period.

7. A beam selecting method for a directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the method comprising:

a detecting step of detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams; and a selecting step of selecting a fixed beam having the largest SIR value in accordance with the SIRs detected in said detecting step.

8. The beam selecting method according to claim 7, wherein a combination of the n fixed beams is changed to another combination of the n fixed beams per unit time period for beam switching so that the SIRs of all the plurality of fixed beams are measured within a predetermined time period.

9. A program for causing a computer to execute a beam selecting method for a directional antenna control device which forms a plurality of fixed beams based on signals received by a plurality of array antenna elements, detects power levels of the fixed beams, and selects a fixed beam in accordance with the detected power levels to generate a received signal based on the selected beam, the program comprising:

a detecting step of detecting, per unit time period for beam switching, a power level of a fixed beam selected in the previous unit time period, power levels of m fixed beams (where m is a positive integer) adjacent to the fixed beam selected in the previous unit time period, and power levels of n fixed beams (where n is a positive integer) of the plurality of fixed beams except for the fixed beam selected in the previous unit time period and the m fixed beams; and a selecting step of selecting a fixed beam having the largest power in accordance with the power levels detected in said detecting step.

10. A program for causing a computer to execute a beam selecting method for a directional antenna control device which forms a plurality of fixed beams based on signals received by a plurality of array antenna elements, detects SIRs (Signal-to-Interference power Ratios) of the fixed beams, and selects a fixed beam in accordance with the detected SIRs to generate a received signal based on the selected beam, the program comprising:

a detecting step of detecting, per unit time period for beam switching, an SIR of a fixed beam selected in the previous unit time period, SIRs of m fixed beams (where m is a positive integer) adjacent to the fixed beam selected in the previous unit time period, and SIRs of n fixed beams (where n is a positive integer) of the plurality of fixed beams except for the fixed beam selected in the previous unit time period and the m fixed beams; and a selecting step of selecting a fixed beam having the largest SIR value in accordance with the SIRs detected in said detecting step.

* * * * *